US009327525B2

(12) United States Patent
Motoyama

(10) Patent No.: US 9,327,525 B2
(45) Date of Patent: May 3, 2016

(54) PRINTER AND CONTROL METHOD OF A PRINTER

(71) Applicant: Seiko Epson Corporation, Tokyo (JP)

(72) Inventor: Hiroyuki Motoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 114 days.

(21) Appl. No.: 14/540,091

(22) Filed: Nov. 13, 2014

(65) Prior Publication Data

US 2015/0145917 A1 May 28, 2015

(30) Foreign Application Priority Data

Nov. 28, 2013 (JP) ..... 2013-245798

(51) Int. Cl.
*B41J 11/00* (2006.01)

(52) U.S. Cl.
CPC ..... *B41J 11/006* (2013.01)

(58) Field of Classification Search
CPC ..... B41J 11/006; B41J 11/06; B41J 11/007; B41J 29/393; B41J 11/42
See application file for complete search history.

(56) References Cited

U.S. PATENT DOCUMENTS

| | | | | |
|---|---|---|---|---|
| 7,413,361 | B2 * | 8/2008 | Kawaguchi | 400/636 |
| 2006/0181556 | A1 | 8/2006 | Wanibuchi et al. | |
| 2008/0056796 | A1 * | 3/2008 | Sakano | 400/231 |
| 2008/0122161 | A1 * | 5/2008 | Fujita | 271/109 |
| 2011/0115866 | A1 * | 5/2011 | Izuma et al. | 347/104 |
| 2012/0050431 | A1 * | 3/2012 | Onishi et al. | 347/101 |

FOREIGN PATENT DOCUMENTS

| | | |
|---|---|---|
| JP | 2003-154693 | 5/2003 |
| JP | 2003-237160 | 8/2003 |
| JP | 2006-225161 | 8/2006 |

* cited by examiner

*Primary Examiner* — Justin Seo

(57) ABSTRACT

When the user operates a paper feed button 9*c* while the access cover 11 is open (steps ST1, ST2), the printer 1 moves the printhead 12 from the printhead-down position 12D to the printhead-up position 12U, and moves the second paper feed roller pair 31 from the nip state to the nip-release state (step ST3). When the access cover 11 is then closed, the printer 1 returns the second conveyance roller pair 31 to the nip state, and returns the printhead 12 to the printhead-down position 12D (steps ST4, ST5). The operation for changing the second conveyance roller pair 31 between the nip state and the nip-release state is therefore intuitive, easily understood, and simple for the user.

9 Claims, 7 Drawing Sheets

PRINTER AND CONTROL METHOD OF A PRINTER

Priority is claimed under 35 U.S.C. §119 to Japanese Application No. 2013-245798, filed on Nov. 28, 2013, which is hereby incorporated by reference in its entirety.

BACKGROUND

1. Technical Field

The present disclosure relates to a control method of a printer that conveys recording paper through a paper conveyance path to a print position by means of a conveyance roller.

2. Related Art

A printer that conveys recording paper through a paper conveyance path past the print position inside a case, and prints on the recording paper with a printhead at the print position is described, for example, in JP-A-2003-237160. The printer disclosed in JP-A-2003-237160 is a serial printer, and the recording paper is conveyed by a platen roller that is pressed against the printhead. If a cover that is part of the case is opened when the recording paper conveyed through the paper conveyance path jams (a paper jam occurs), the support member that holds the printhead falls of its own weight in the direction away from the platen roller, and the paper is released from being nipped by the printhead and the platen roller. Removing the recording paper from the paper conveyance path is therefore simple.

Recording paper in an inkjet printer is fed to the print position by a conveyance roller pair disposed near the print position. Printers having such a conveyance roller pair include devices in which a mechanism that releases the conveyance roller pair from the nip position and moves the conveyance roller pair from the nip state to the nip-release state as a result of the user simultaneously operating plural operating buttons on the case when the recording paper conveyed through the paper conveyance path jams.

In this configuration, removing the recording paper that jammed is done by the user. However, simultaneously operating plural buttons to set the conveyance roller pair to the nip-release state can be difficult for the user to do without the aid of an operating prompt displayed on an LCD panel, for example.

SUMMARY

A printer and a control method of a printer according to the present disclosure make the operation for changing the conveyance roller pair from the nip state to the nip-release state simple and easy to understand when the user needs to remove recording paper that has jammed from the conveyance path.

A printer according to one aspect of the present invention includes a printhead; a paper conveyance path extending past the print position of the printhead; a conveyance roller pair that conveys recording paper through the paper conveyance path to the print position; a case that houses the printhead, the paper conveyance path, and the conveyance roller pair; a roller pair state changing mechanism that moves the conveyance roller pair alternately between a nip state and a nip-release state; an access cover that is disposed to the case to open and close, and when open exposes the paper conveyance portion of the paper conveyance path including the print position; an operating button; a detector that detects if the access cover is open; and a nip state release control unit that, when the operating button is operated when the access cover is detected in the open position, drives the roller pair state changing mechanism and changes the conveyance roller pair to the nip-release state.

In this aspect of at least one embodiment of the present invention, when the access cover of the case is open and the operating button is operated, the nip state release control unit drives the roller pair state changing mechanism, and changes the conveyance roller pair from the nip state to the nip-release state. Because the user opens the access cover that exposes the paper conveyance path to the outside when removing recording paper from the paper conveyance path, the operation of opening the access cover is intuitive and easy to understand. Furthermore, because the user can set the conveyance roller pair to the nip-release position by operating a single operating button after opening the access cover, operation is simple compared with a configuration requiring operating plural operating buttons at the same time. The nip state as used herein is the state in which the two rollers constituting the conveyance roller pair are pressed together and can convey the recording paper, and the nip-release state is the state in which the two rollers constituting the conveyance roller pair are separated from each other.

A printer according to another aspect of at least one embodiment of the present invention also has a nip state control unit that drives the roller pair state changing mechanism and returns the conveyance roller pair to the nip state when the open state of the access cover is not detected when the conveyance roller pair is in the nip-release state.

Thus comprised, the user does not need to operate an operating button to return the conveyance roller pair to the nip state.

A printer according to another aspect of at least one embodiment of the present invention also has a platen that defines the print position; a printhead moving mechanism that moves the printhead between a print position where the platen gap between the platen and the printhead is a first distance, and a retracted position where the platen gap is a second distance that is greater than the first distance; a print control unit that sets the printhead to the print position and prints on recording paper at the print position; a printhead retraction control unit that drives the printhead moving mechanism and moves the printhead from the print position to the retracted position if the operating button is operated while the access cover is detected in the open position; and a printhead return control unit that drives the printhead moving mechanism and returns the printhead to the print position if the printhead is at the retracted position when the access cover is not detected in the open position.

Thus comprised, when the conveyance roller pair is in the nip-release state, the distance between the printhead and the platen increases. Removing the recording paper that jammed is therefore easy. Furthermore, because the distance between the printhead and the platen increases, the recording paper contacting the printhead and damaging the printhead can be prevented or suppressed when removing recording paper that jammed from the paper conveyance path.

A printer according to another aspect of at least one embodiment of the present invention also has a paper feed control unit that drives the conveyance roller pair and conveys the recording paper a predetermined conveyance distance if the operating button is operated when the access cover is not detected in the open position.

Thus comprised, an operating button that is used as a paper feed button for conveying the recording paper a set conveyance distance only can be used to change the conveyance roller pair from the nip state to the nip-release state. Because the paper feed button is an operating button related to conveying the recording paper, operating the paper feed button in order to remove a paper jam that occurred while conveying the recording paper will not feel unnatural for the user.

In a printer according to another aspect of at least one embodiment of the present invention, the nip-release control unit moves the conveyance roller pair from the nip state to the nip-release state when the operating button is operated for a predetermined time or more; and the printhead retraction control unit moves the printhead from the print position to the retracted position when the operating button is operated for the set time or longer.

Thus comprised, changing the state of the conveyance roller pair or moving the printhead as a result of mistakenly operating the operating button can be prevented.

Another aspect of at least one embodiment of the present invention is a control method of a printer, including: detecting an open state of an access cover that exposes a paper conveyance portion including the print position of a printhead on a paper conveyance path to the outside of a case that houses the conveyance roller pair, the printhead, and the paper conveyance path; changing the conveyance roller pair from the nip state to the nip-release state if an operating button is operated while the access cover is open; and returning the conveyance roller pair to the nip state when the access cover closes.

Thus comprised, when an access cover disposed to the case is opened and the operating button is operated, the conveyance roller pair changes from the nip state to the nip-release state. Because the user opens the access cover that exposes part of the paper conveyance path to the outside when removing recording paper from the paper conveyance path, the operation of opening the access cover is intuitive and easy to understand. Furthermore, because the user can set the conveyance roller pair to the nip-release position by operating a single operating button after opening the access cover, operating the operating button is simple compared with a configuration requiring operating plural operating buttons at the same time. When the access cover closes, the conveyance roller pair returns from the nip-release state to the nip state. The user therefore does not need to operate the operating button to return the conveyance roller pair to the nip state.

A control method of a printer according to another aspect of at least one embodiment of the present invention also includes: setting the printhead to a print position where the platen gap to the platen defining the print position is a first distance enabling printing, and printing; moving the printhead to a retracted position where the platen gap is a second distance that is greater than the first distance when the operating button is operated while the access cover is open; and returning the printhead from the retracted position to the print position when the access cover is closed.

Thus comprised, when the conveyance roller pair is in the nip-release state, the distance between the printhead and the platen increases. Removing the recording paper that jammed is therefore easy. Furthermore, because the distance between the printhead and the platen increases, the recording paper contacting the printhead and damaging the printhead can be prevented or suppressed when removing recording paper that jammed from the paper conveyance path.

A control method of a printer according to another aspect of at least one embodiment of the present invention also includes: conveying the recording paper a predetermined conveyance distance by the conveyance roller pair when the operating button is operated while the access cover is closed.

Thus comprised, an operating button that is used as a paper feed button for conveying the recording paper a set conveyance distance only can be used to change the conveyance roller pair from the nip state to the nip-release state. Because the paper feed button is an operating button related to conveying the recording paper, operating the paper feed button in order to remove a paper jam that occurred while conveying the recording paper will not feel unnatural for the user.

A control method of a printer according to another aspect of at least one embodiment of the present invention also includes: moving the conveyance roller pair from the nip state to the nip-release state, and moving the printhead from the print position to the retracted position, if the operating button is operated for the predetermined time or more.

Thus comprised, changing the state of the conveyance roller pair or moving the printhead as a result of mistakenly operating the operating button can be prevented.

Other objects and attainments together with a fuller understanding of the invention will become apparent and appreciated by referring to the following description and claims taken in conjunction with the accompanying drawings.

DESCRIPTION OF EMBODIMENTS

A printer according to at least one embodiment of the present invention is described below with reference to the accompanying figures.

Figure 1:
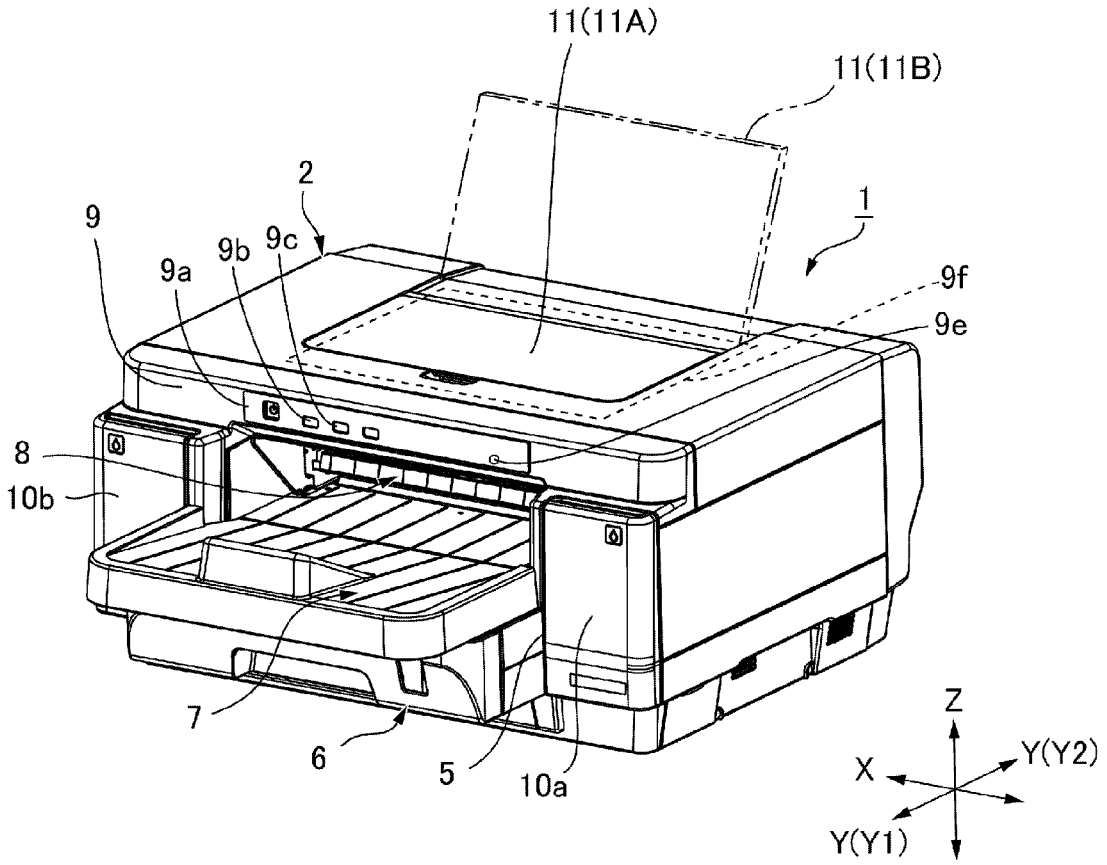
FIG. 1 is an oblique view of a printer according to some embodiments of the invention.

FIG. 1 is an external oblique view from the front of a printer according to embodiments of the invention. The printer 1 has a printer cabinet 2 having a basically rectangular box-like shape that is long on the transverse axis X widthwise to the printer.

A paper cassette loading unit 5 is disposed in the printer cabinet 2. The paper cassette loading unit 5 opens to the front Y1 (the front on the longitudinal printer axis Y) at a position toward the bottom on the vertical printer axis Z at the front of the printer cabinet 2. A paper cassette 6 can be loaded from the front Y1 into the paper cassette loading unit 5.

A paper discharge tray 7 is attached above the paper cassette loading unit 5. The front end of the paper discharge tray 7 protrudes to the front Y1 from the printer cabinet 2.

A rectangular paper exit 8 extending toward the back Y2 (the back on the longitudinal axis Y) is formed above the paper discharge tray 7.

Note that the transverse axis X, longitudinal axis Y, and vertical axis Z are all perpendicular to each other.

The case 9 of the printer cabinet 2 has an operating panel 9*a* at the front above the paper exit 8. A power switch 9*b* and paper feed button 9*c* (operating button) are disposed to the operating panel 9*a*. The paper feed button 9*c* is an operating button for advancing the printing paper (recording paper) P a preset distance. An indicator 9*e* for signaling that a paper jam or other error has occurred, for example, is also disposed to the operating panel 9*a*. The indicator 9*e* in this example is an LED.

Rectangular access covers 10*a*, 10*b* are attached to the front of the case 9 on opposite sides of the paper discharge tray 7 and paper exit 8. Opening the access covers 10*a*, 10*b* opens the ink cartridge loading unit 10 (see FIG. 3) and enables replacing the ink cartridges (not shown in the figure), for example.

A rectangular opening 9*f* is formed in the middle of the top of the case 9. The opening 9*f* can be closed by an access cover 11 openably attached to the printer case. The access cover 11 is rectangular and long on the transverse axis X, and can pivot open and closed at the back end thereof. The axis of rotation of the access cover 11 extends widthwise to the printer. The access cover 11 can move between a horizontal position 11A where it is level along the top of the case 9 and covers the opening 9*f*, and an upright position 11B to which it pivots 90 degrees or more from the horizontal position 11A and opens the opening 9*f*. When the access cover 11 is in the horizontal position 11A, the access cover 11 is in the closed position. When the access cover 11 moves away from the horizontal position 11A to the upright position 11B, the access cover 11 is in the open position.

Internal Configuration

Figure 2:
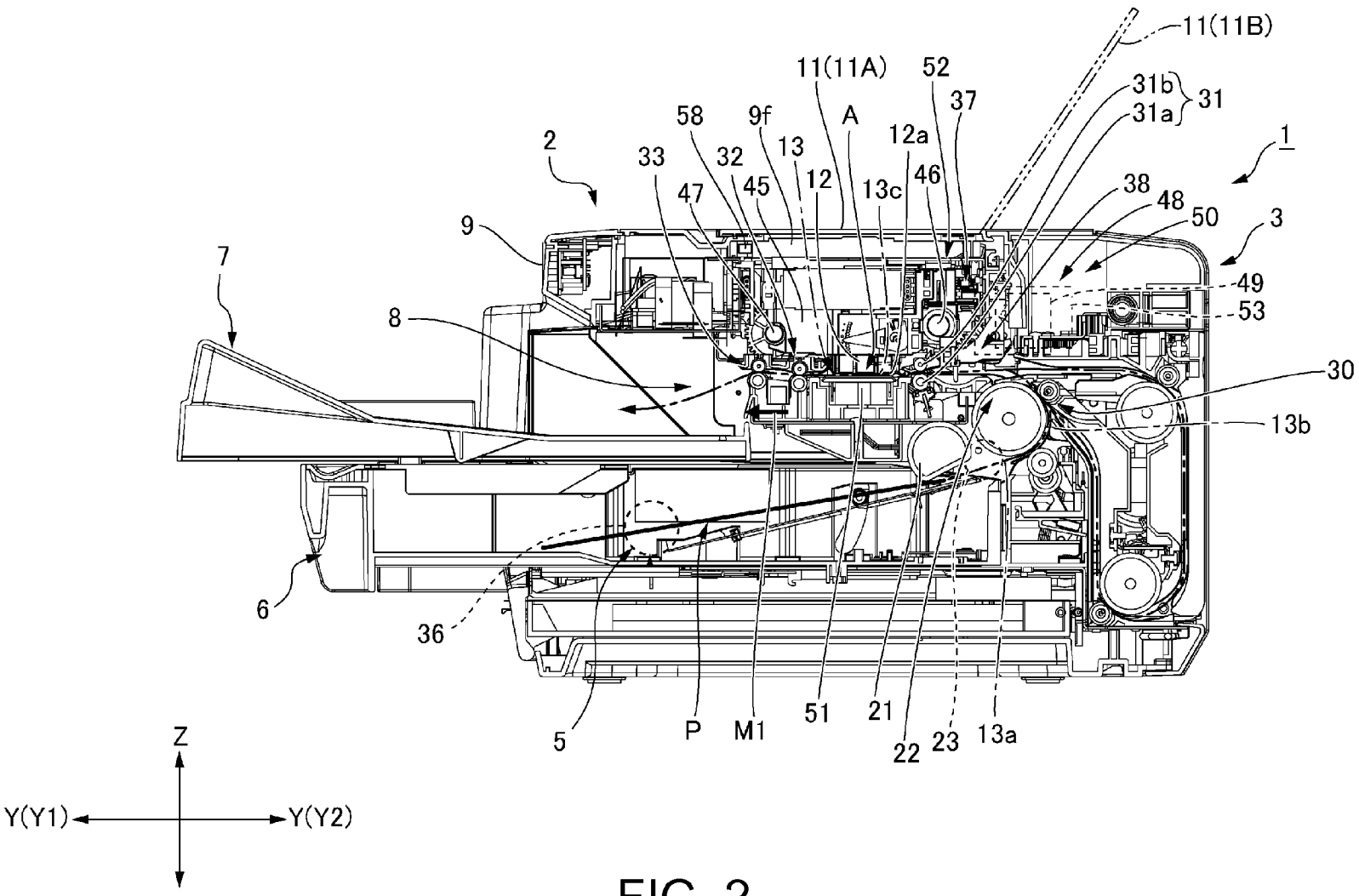
FIG. 2 is a vertical section view of the internal configuration of the printer in FIG. 1.

FIG. 2 is a vertical section view showing the internal configuration of the printer 1.

A paper conveyance path 13 going from the paper cassette 6 past the print position A on the paper supply path 12 to the paper exit 8 is formed inside the case 9.

The paper conveyance path 13 includes a sloped conveyance path portion 13*a* rising diagonally toward the printer back Y2 from the back end of the paper cassette 6, a curved conveyance path portion 13*b* that curves continuously from the back end of the sloped conveyance path portion 13*a* up and around toward the printer front Y1, and a horizontal conveyance path portion 13*c* extending substantially horizontally from the top front end of the curved conveyance path portion 13*b* toward the printer front Y1. The horizontal conveyance path portion 13*c* passes the print position A of the printhead 12 and continues to the paper exit 8.

Inside the printer 1 are a paper feed roller 21 that supplies printing paper P stored in the paper cassette 6 to the paper conveyance path 13, and a conveyance mechanism 22 that conveys the printing paper P through the paper conveyance path 13. The paper feed roller 21 is located above the back end part of the paper cassette 6 on the longitudinal axis Y. The paper feed roller 21 turns as driven by the paper feed motor 23, and feeds the printing paper P to the paper conveyance path 13.

The conveyance mechanism 22 includes a first paper feed roller pair 30, a second paper feed roller pair (conveyance roller pair) 31, a first discharge roller pair 32, and a second discharge roller pair 33 disposed along the paper conveyance path 13.

The first paper feed roller pair 30, second paper feed roller pair 31, first discharge roller pair 32, and second discharge roller pair 33 are disposed in order from the upstream side to the downstream side in the conveyance direction Ml between the paper cassette 6 and the paper exit 8. The first paper feed roller pair 30 is disposed to the curved conveyance path portion 13*b*, and the second paper feed roller pair 31, the first discharge roller pair 32, and the second discharge roller pair 33 are disposed to the horizontal conveyance path portion 13*c*.

The drive source of the conveyance mechanism 22 is a conveyance motor 36. The conveyance motor 36 is a DC motor, and is disposed beside the paper cassette 6 on the transverse axis X. The conveyance mechanism 22 conveys the printing paper P in the conveyance direction Ml toward the paper exit 8 as driven by the conveyance motor 36.

Figure 6A:
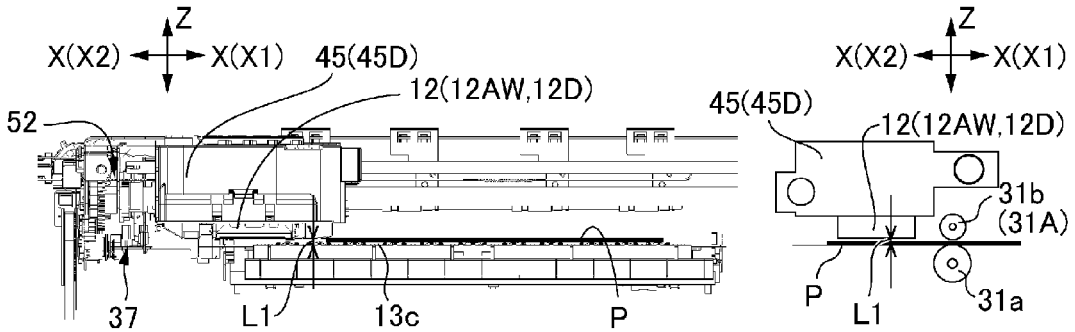
FIGS. 6A-6C illustrate operation when the paper feed button is pressed while the access cover is open.

The second paper feed roller pair 31 is located on the back Y2 side of the print position A near the print position A. The second paper feed roller pair 31 includes a feed roller 31*a* to which drive power is transferred from the conveyance motor 36, and a follower roller 31*b* that follows the feed roller 31*a*. The feed roller 31*a* has a friction layer of dispersed inorganic particles on the surface of the roller. A roller moving mechanism 37 (roller pair state changing mechanism) that moves the follower roller 31*b* between a nipping position 31A (see FIG. 6A) pressed against the feed roller 31*a* and a released position 31B (see FIG. 6C) separated from the feed roller 31*a* is disposed above the horizontal conveyance path portion 13*c*. The second paper feed roller pair 31 is in the nipping position when the follower roller 31*b* is set to the nipping position 31A. When the follower roller 31*b* is set to the released position 31B, the second paper feed roller pair 31 is in the release position. The second paper feed roller pair 31 conveys the printing paper P when the follower roller 31*b* is in the nipping position 31A.

A paper detector 38 is disposed between the first paper feed roller pair 30 and the second paper feed roller pair 31. The paper detector 38 detects the printing paper P conveyed through the paper conveyance path near the second paper feed roller pair 31.

The printhead 12 is an inkjet head. The printhead 12 is mounted on the carriage 45 with the nozzle face 12*a* facing down. The carriage 45 is supported slidably on a carriage guide rail 46 and a carriage support rail 47 that extend substantially horizontally on the transverse axis X above the horizontal conveyance path portion 13*c*. A platen 51 is disposed below the printhead 12 with a specific gap therebetween. The platen 51 determines the print position A.

The carriage guide rail 46 and carriage support rail 47 are parallel to each other, and the carriage guide rail 46 is disposed behind the carriage support rail 47 on the printer back Y2 side. A carriage drive mechanism 48 that moves the carriage 45 bidirectionally on the transverse axis X along the carriage guide rail 46 and the carriage support rail 47 is disposed behind the carriage guide rail 46 on the printer back Y2 side. The drive source of the carriage drive mechanism 48 is a carriage motor 49. The carriage guide rail 46, the carriage support rail 47, and the carriage drive mechanism 48 embody a carriage moving mechanism 50. The carriage 45 and the carriage moving mechanism 50 are disposed above the horizontal conveyance path portion 13*c*.

A carriage lift mechanism 52 (head lift mechanism) that moves the carriage 45 on the vertical axis Z is also disposed above the horizontal conveyance path portion 13*c*. The carriage lift mechanism 52 moves the carriage 45 and the printhead 12 up and down by moving the carriage guide rail 46 and the carriage support rail 47 on the vertical axis Z.

Figure 6B:
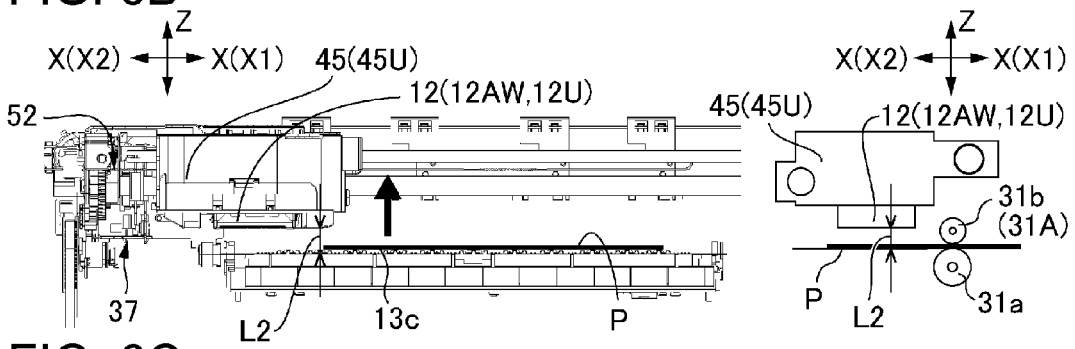
Figure 6C:
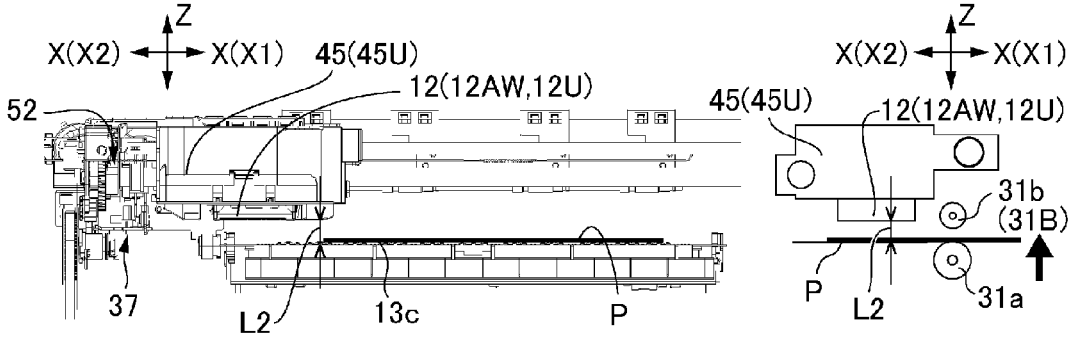

The carriage lift mechanism 52 moves the carriage 45 between a carriage-down position 45D (see FIG. 6A) and a carriage-up position 45U (see FIG. 6B). When the carriage 45 is at the carriage-down position 45D, the printhead 12 is at the printhead-down position 12D where the gap between the platen 51 and the printhead 12 is a first distance L1. When the carriage 45 is at the carriage-up position 45U, the printhead 12 is at a printhead-up position 12U (retracted position) where the platen gap is a second distance L2 that is greater than the first distance L1. The printhead-down position 12D is the print position where the printhead 12 can print on the printing paper P conveyed past the print position A. Note that except for when a printing paper P jam occurs, for example, the carriage 45 is normally at the carriage-down position 45D. The printhead 12 is therefore also normally at the printhead-down position 12D.

The drive source of the carriage lift mechanism 52 is a lift motor 53 that can be driven forward and reverse. The lift motor 53 is disposed on the transverse axis X on the opposite side of the horizontal conveyance path portion 13*c* as the carriage motor 49.

Figure 3:
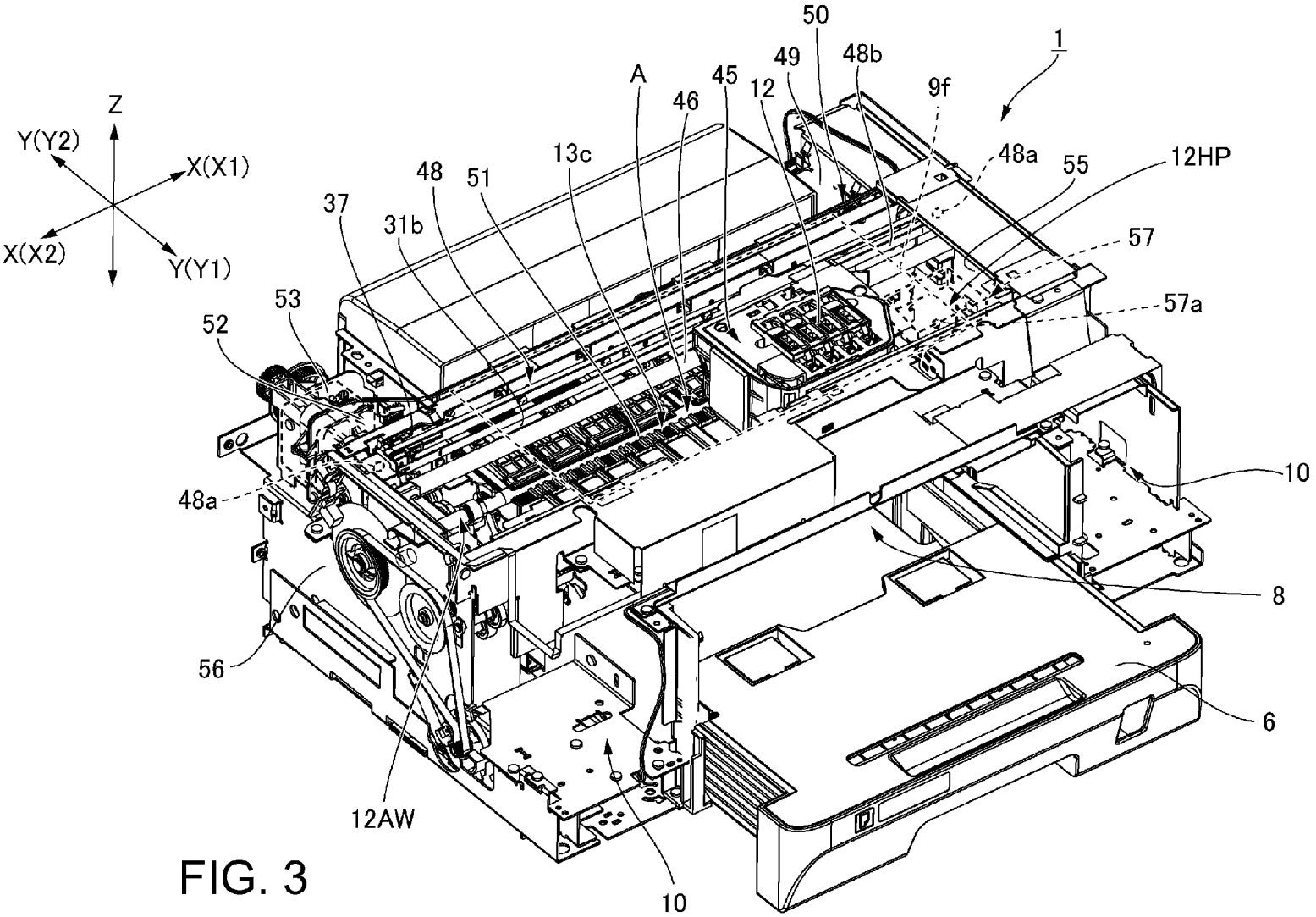
FIG. 3 is an oblique view of the printer from the front when the case is removed.
Figure 4:
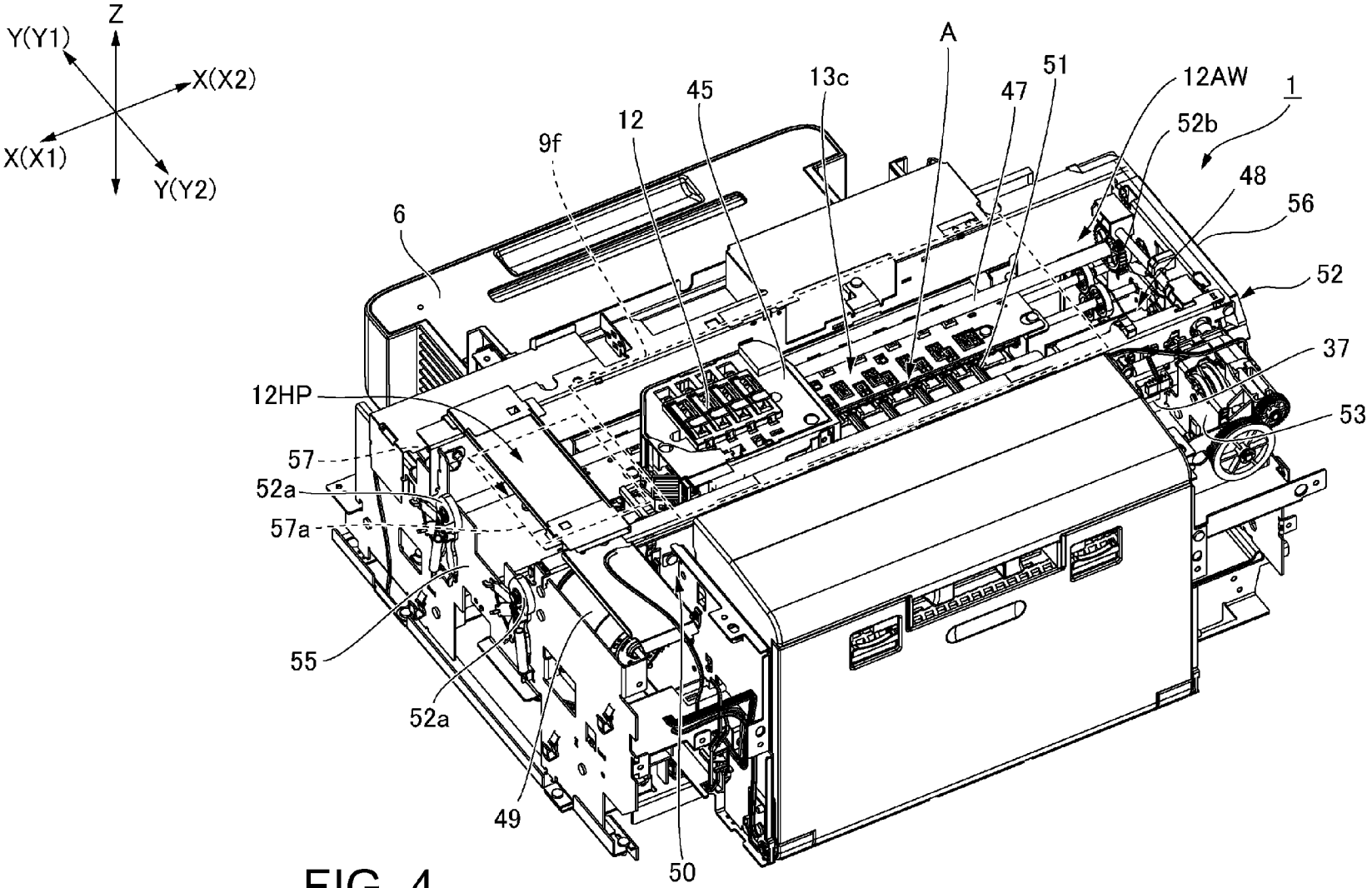
FIG. 4 is an oblique view of the printer from the back when the case is removed.

The carriage moving mechanism 50 and the carriage lift mechanism 52 are described in further detail below with reference to FIG. 3 and FIG. 4. FIG. 3 is an oblique view of the printer 1 from diagonally above the printer front Y1 without the case 9 and the paper discharge tray 7. FIG. 4 is an oblique view of the printer 1 from diagonally above the printer back Y2 without the case 9 and the paper discharge tray 7.

As shown in FIG. 3 and FIG. 4, the carriage guide rail 46 and the carriage support rail 47 are supported at one end thereof by a first side frame 55, which extends up and on the longitudinal axis Y, at the ends on the first direction X1 of the transverse axis X.

The first side frame 55 is disposed with a specific gap to the horizontal conveyance path portion 13*c*.

The other ends of the carriage guide rail 46 and the carriage support rail 47 are supported by a second side frame 56, which is parallel to the first side frame 55, at the ends on the second direction X2 of the transverse axis X.

The second direction X2 is the opposite direction as the first direction X1.

The second side frame 56 is disposed with a specific gap to the horizontal conveyance path portion 13*c*.

The first side frame 55 and second side frame 56 support the carriage guide rail 46 and the carriage support rail 47 movably on the vertical axis Z. The first side frame 55 and second side frame 56 also support the carriage guide rail 46 and the carriage support rail 47 rotatably on their axes of rotation.

As shown in FIG. 3, the carriage drive mechanism 48 includes a pair of timing pulleys 48*a*, which are respectively disposed near the first side frame 55 and near the second side frame 56, and a timing belt 48*b* that is mounted on the pair of timing pulleys 48*a*. One part of the timing belt 48*b* is fastened to the carriage 45. By driving one of the timing pulleys 48*a* with the carriage motor 49, the carriage 45 moves along the carriage guide rail 46 and the carriage support rail 47.

As shown in FIG. 4, the carriage lift mechanism 52 includes eccentric cams 52*a*, cam support parts (not shown in the figure) that contact the outside cam surfaces of the eccentric cams 52*a*, and a power transfer mechanism 52*b*. The eccentric cams 52*a* are attached to one end of both the carriage guide rail 46 and the carriage support rail 47. The power transfer mechanism 52*b* transfers the drive power of the lift motor 53 to the carriage guide rail 46 and the carriage support rail 47 and causes the rails to rotate on their axes of rotation.

A cam support part is disposed to both the first side frame 55 and the second side frame 56. When the lift motor 53 is driven, the carriage guide rail 46 and the carriage support rail 47 turn synchronously. As a result, the eccentric cams 52*a* also turn, and rotation of the eccentric cam 52*a* causes the carriage guide rail 46 and the carriage support rail 47 to move up and down.

The lift motor 53 that is the drive source of the carriage lift mechanism 52 is also the drive source of the roller pair state changing mechanism 37. More specifically, drive power from the lift motor 53 is transferred to the roller pair state changing mechanism 37. In this example, after driving the lift motor 53 forward and moving the carriage 45 from the carriage-down position 45D to the carriage-up position 45U, the drive power of the lift motor 53 is then transferred to the roller pair state changing mechanism 37 if driving the lift motor 53 forward continues. As a result, the follower roller 31*b* moves from the nipping position 31A to the released position 31B.

If the lift motor 53 is driven in reverse when the follower roller 31*b* is set to the released position 31B, the follower roller 31*b* returns from the released position 31B to the nipping position 31A. More specifically, the second paper feed roller pair 31 changes from the release state to the nipping state. When the lift motor 53 is then driven further in reverse, the carriage lift mechanism 52 is driven, and the carriage 45 moves from the carriage-up position 45U to the carriage-down position 45D. Note that except when a printing paper P jam occurs, for example, the follower roller 31*b* is normally at the nipping position 31A and the second paper feed roller pair 31 is in the nipping state.

The home position 12HP of the printhead 12 is between the horizontal conveyance path portion 13*c* and the first side frame 55. The maintenance mechanism 57 of the printhead 12 is disposed to the home position 12HP. The maintenance mechanism 57 has a head cap 57*a* and a cap lift mechanism (not shown in the figures).

The head cap 57*a* is disposed to a position opposite the nozzle face 12*a* of the printhead 12 at the home position 12HP. The cap lift mechanism moves the head cap 57*a* in the direction toward and the direction away from the printhead 12 of the printhead 12 at the home position 12HP. When the printer 1 is in the standby mode, the carriage drive mechanism 48 moves the printhead 12 to the home position 12HP, resulting in the printhead 12 being covered and protected by the head cap 57*a*.

The away position 12AW of the printhead 12 is between the horizontal conveyance path portion 13*c* and the second side frame 56. The away position 12AW is a space to which the printhead 12 moves outside of the horizontal conveyance path portion 13*c* when printing the end part of the second direction X2 of the printing paper P during the printing operation that prints to the printing paper P while the printhead 12 moves on the transverse axis X. The printhead 12 moves on the carriage guide rail 46 between the home position 12HP and the away position 12AW as a result of the carriage moving mechanism 50 moving the carriage 45 bidirectionally on the transverse axis X.

An open cover detector 58 (detector) that detects if the access cover 11 is open is disposed above the carriage support rail 47 as shown in FIG. 2. When the access cover 11 is in the horizontal position 11A, the open cover detector 58 detects that the access cover 11 is closed as a result of contact with the access cover 11. When the access cover 11 moves from the horizontal position 11A to the upright position 11B, the open cover detector 58 detects that the access cover 11 is open. When the access cover 11 is in the upright position 11B, the portion of the paper conveyance path 13 including the print position A is exposed to the outside through the opening 9*f*.

Control System

Figure 5:
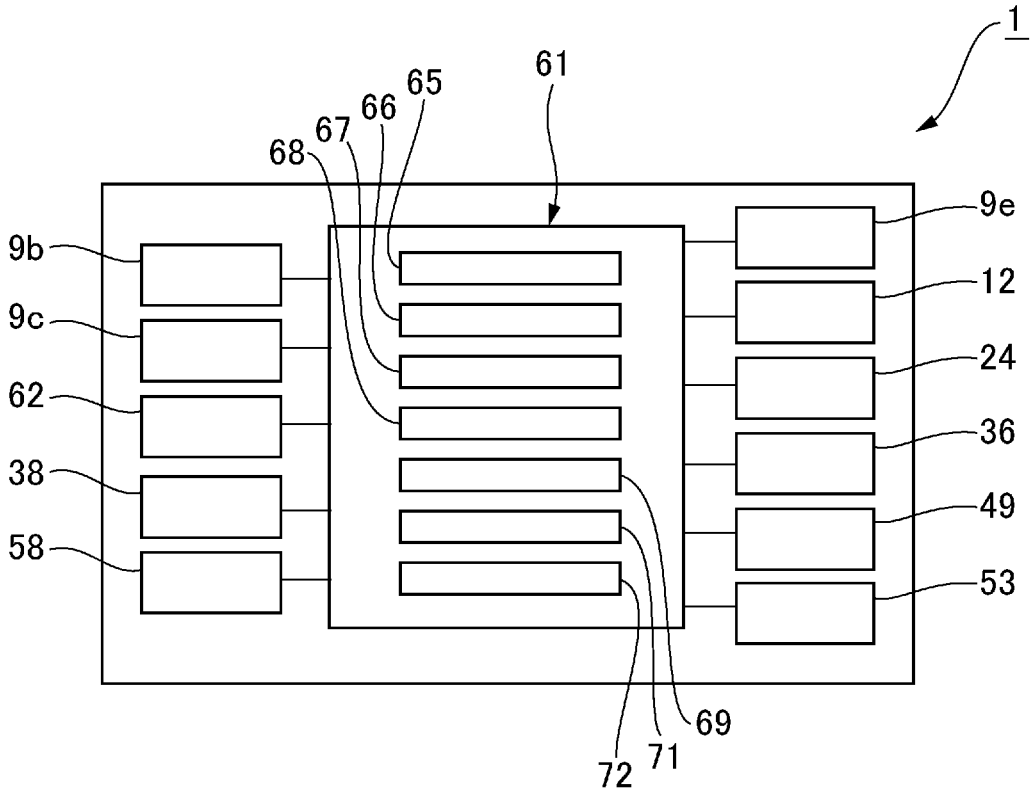
FIG. 5 is a block diagram illustrating the control system of the printer.

FIG. 5 is a block diagram illustrating the control system of the printer. FIG. 6 illustrates the release operation that moves the second paper feed roller pair 31 from the nipping position to the release position.

As shown in FIG. 5, the control system of the printer 1 is configured around a control unit 61 including a CPU. A power switch 9*b* and a paper feed button 9*c* are connected to the control unit 61. Also connected to the control unit 61 are a communication unit 62 that communicatively connects the printer 1 to a computer or other external device, the paper detector 38, and the open cover detector 58. Also connected to the control unit 61 are a display 9*e*, the printhead 12, the paper feed motor 23, the conveyance motor 36, the carriage motor 49, and the lift motor 53. The communication unit 62 sequentially inputs print data supplied from an external device to the control unit 61.

The control unit 61 includes a paper supply control unit 65, a paper position detection unit 66, a conveyance control unit (paper feed control unit) 67, a print control unit 68, and a paper jam detection unit 69. The control unit 61 also has a nip-release control unit 71 (printhead retraction control unit), and a nip state control unit 72 (printhead return control unit).

The paper supply control unit 65 drives the paper feed motor 23 to turn the paper feed roller 21, and feed printing paper P from the paper cassette 6 to the horizontal conveyance path portion 13*c*.

When the printing paper P is detected by the paper detector 38, the paper position detection unit 66 acquires the position of the printing paper P on the paper conveyance path 13 based on the amount the conveyance motor 36 is driven and the length of the printing paper P in the conveyance direction. The amount the conveyance motor 36 is driven is based on the drive time of the conveyance motor 36, for example. The length of the printing paper P can be acquired based on the paper size information contained in the print data, or the paper size information of the printing paper P set for the printer 1.

The conveyance control unit 67 drives the conveyance motor 36 to convey the printing paper P fed from the paper cassette 6 to the paper conveyance path 13 in the conveyance direction Ml. The conveyance control unit 67 also positions the printing paper P to the print position A based on the position of the printing paper P acquired by the paper position detection unit 66. When the paper feed button 9*c* is pressed when an open cover state is not detected by the access cover 11, the conveyance control unit 67 drives the conveyance motor 36 to advance the printing paper P a predetermined conveyance distance by means of the conveyance mechanism 22.

The print control unit 68 runs a printing process based on the print data supplied from an external device. A printing operation in which the printhead 12 is driven to eject ink droplets to the printing paper P at the print position A while driving the carriage motor 49 and moving the carriage 45 on the transverse axis X, and a paper feed operation that drives the conveyance motor 36 and advances the printing paper P a specific amount, alternately repeat in the printing process. When the printing process ends, the print control unit 68 drives the conveyance motor 36 and discharges the printing paper P from the paper exit 8.

The paper jam detection unit 69 detects if the printing paper P conveyed through the paper conveyance path 13 jams. When a paper jam is detected, the paper jam detection unit 69 also stops the printhead 12, conveyance motor 36, and carriage motor 49, and drives the display 9*e* to report that a paper jam occurred.

The paper jam detection unit 69 detects paper jams based on change in the drive current of the conveyance motor 36 or change in the drive current of the carriage motor 49. For example, if a paper jam occurs, the printing paper P does not advance when the conveyance motor 36 is driven, and rotation of the first paper feed roller pair 30 and the second paper feed roller pair 31 stops. As a result, the drive current of the conveyance motor 36 rises. The paper jam detection unit 69 can therefore detect a paper jam based on an increase in the drive current of the conveyance motor 36. If the paper jam occurs at the print position A, moving the carriage 45 on the transverse axis X also becomes difficult, and the drive current of the carriage motor 49 increases. Therefore, the paper jam detection unit 69 can also detect a paper jam based on an increase in the drive current of the carriage motor 49. The paper jam detection unit 69 also detects paper jams based on the driven amount of the conveyance motor 36 and the output from the paper detector 38. For example, if the printing paper P is not detected by the paper detector 38 even though the conveyance motor 36 has been driven enough for the printing paper P to have reached the print position A, a paper jam is detected by the paper jam detection unit 69.

The nip-release control unit 71 monitors operation of the paper feed button 9*c* when the open cover detector 58 detects that the access cover 11 is open. If the paper feed button 9*c* is operated, the nip-release control unit 71 moves the printhead 12 from the printhead-down position 12D to the printhead-up position 12U (retracted position), and moves the second paper feed roller pair 31 from the nip position to the release position. In some embodiments of the invention, the nip-release control unit 71 detects operation of the paper feed button 9*c* when the paper feed button 9*c* is pressed continuously (operated) for a preset time or more. The preset time in this embodiment is 3 seconds.

More specifically, if the paper feed button 9*c* is operated when the access cover 11 is detected in the open position, the nip-release control unit 71 drives the lift motor 53 forward and raises the carriage 45 by means of the carriage lift mechanism 52. As a result, the carriage 45 moves from the carriage-down position 45D shown in FIG. 6A to the carriage-up position 45U shown in FIG. 6B, and the printhead 12 therefore moves from the printhead-down position 12D shown in shown in FIG. 6A to the printhead-up position 12U shown in FIG. 6B. The nip-release control unit 71 also continues driving the lift motor 53 forward and raises the follower roller 31*b* by means of the roller pair state changing mechanism 37. As a result, the follower roller 31*b* moves from the nipping position 31A shown in FIG. 6B to the released position 31B shown in FIG. 6C.

When the access cover 11 is no longer open and the second paper feed roller pair 31 is in the release position, the nip state control unit 72 returns the second paper feed roller pair 31 to the nip position and returns the printhead 12 from the printhead-up position 12U to the printhead-down position 12D.

More specifically, when the access cover 11 is in the horizontal position 11A, the nip state control unit 72 drives the lift motor 53 in reverse and lowers the follower roller 31*b* by means of the roller pair state changing mechanism 37. As a result, the follower roller 31*b* moves from the released position 31B shown in FIG. 6C to the nipping position 31A shown in FIG. 6B. The nip-release control unit 71 continues driving the lift motor 53 in reverse, and lowers the carriage 45 by means of the carriage lift mechanism 52. As a result, the carriage 45 moves from the carriage-up position 45U shown in FIG. 6B to the carriage-down position 45D shown in FIG. 6A, and the printhead 12 therefore moves from the printhead-up position 12U shown in FIG. 6B to the printhead-down position 12D shown in FIG. 6A.

Operation During the Printing Process

When the printer power turns on, the printer 1 is initialized. When initialization is completed, the printing paper P is nipped and can be conveyed by the second paper feed roller pair 31. The printhead 12 is in the printhead-down position 12D.

When print data is supplied from an external device after the initialization operation ends, the paper supply control unit 65 drives the paper feed motor 23 and feeds the printing paper P stored in the paper cassette 6 to the paper conveyance path 13 by means of the paper feed roller 21. The conveyance control unit 67 also drives the conveyance motor 36 and conveys the printing paper P fed into the paper conveyance path 13 in the conveyance direction Ml by means of the conveyance mechanism 22. The conveyance control unit 67 then positions the intended start printing position on the surface of the printing paper P to the print position A.

When the printing paper P is set to the print position A, the print control unit 68 drives the printhead 12, the carriage motor 49, and the conveyance motor 36, and prints on the surface of the printing paper P. When the printing process ends, the print control unit 68 drives the conveyance motor 36 and discharges the printing paper P from the paper exit 8 by means of the conveyance mechanism 22.

Operation when a Paper Jam Occurs

Figure 7:
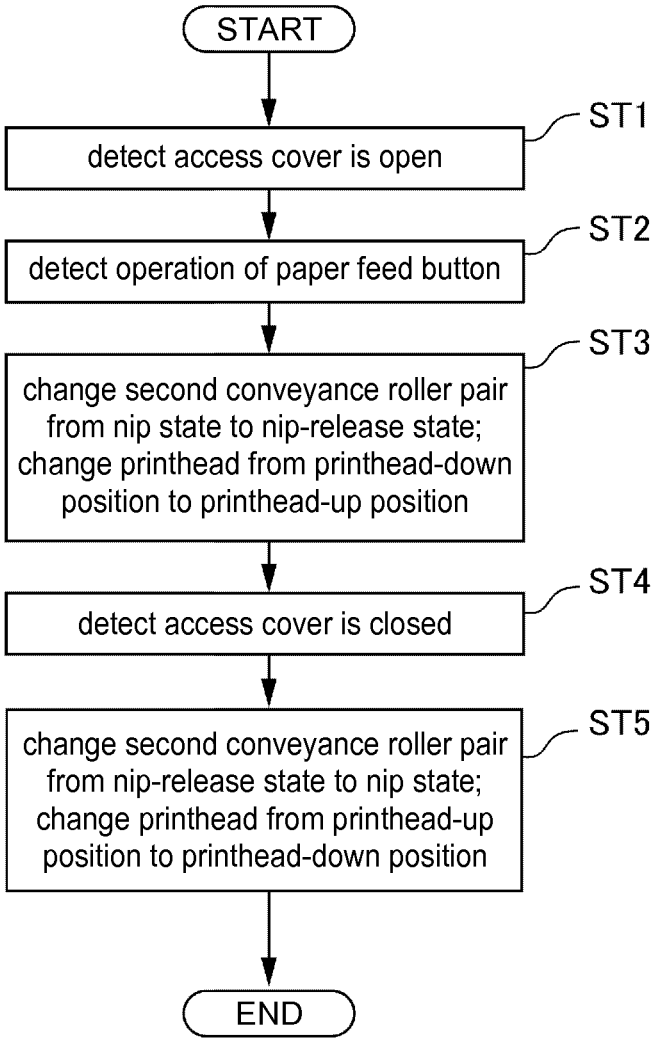
FIG. 7 is a flow chart of operation when a paper jam occurs.

The process executed when a paper jam occurs is described next with reference to FIG. 6 and FIG. 7. FIG. 7 is a flow chart of the process executed when a paper jam occurs. Note that the printhead 12 is shown at the away position 12AW in the example shown in FIG. 6, but the same process is executed when the printhead 12 is positioned opposite the paper conveyance path 13 and when the printhead 12 is at the home position 12HP.

If the paper jam detection unit 69 detects that the printing paper P has jammed during the printing process, for example, the paper jam detection unit 69 stops the printhead 12, the conveyance motor 36, and the carriage motor 49. The paper jam detection unit 69 then drives the display 9*e* to report that a paper jam occurred. If the printing paper P that jammed is exposed from the paper exit 8 when the paper jam is reported, the printing paper P is pulled out to the front Y1 by the user and removed from the paper conveyance path 13.

If part of the printing paper P held by the second paper feed roller pair 31 tears off when the user pulls the printing paper P, the scrap portion held by the second paper feed roller pair 31 remains on the paper conveyance path 13. If a paper scrap remains in the paper conveyance path 13, a paper jam may occur again during the next printing process. If the paper scrap moves inside the case 9, damage to the printhead 12 and other components inside the case may also result. The user must therefore remove any paper scraps from the paper conveyance path 13.

When removing such paper scraps, the user first opens the access cover 11. More specifically, the user moves the access cover 11 from the horizontal position 11A to the upright position 11B. That the access cover 11 is open is therefore detected (step ST1). Next, the user presses (operates) the paper feed button 9*c* for the preset time. This operation of the paper feed button 9*c* is detected by the nip-release control unit 71 (step ST2).

When operation of the paper feed button 9*c* is detected, the nip-release control unit 71 drives the lift motor 53 and moves the printhead 12 from the printhead-down position 12D to the printhead-up position 12U. The nip-release control unit 71 also drives the lift motor 53 and moves the second paper feed roller pair 31 from the nip position to the release position (step ST3).

As a result, the paper scrap is released by the second paper feed roller pair 31. The user can therefore remove the paper scrap from above the paper conveyance path 13 through the opening 9*f*. Because the printhead 12 is set to the printhead-up position 12U when the user removes the paper scrap, the user can also easily remove the scrap from the paper conveyance path 13. In addition, because the printhead 12 is at the printhead-up position 12U, the paper will not contact the printhead 12 when the user removes the paper scrap, and damage to the printhead 12 can be prevented or suppressed.

When the user then closes the access cover 11 and the access cover 11 is detected in the closed position (step ST4), the nip state control unit 72 drives the lift motor 53 in reverse, returns the second paper feed roller pair 31 from the release state to the nip state, and returns the printhead 12 from the printhead-up position 12U to the printhead-down position 12D (step ST5). Therefore, when print data is next supplied, the printer 1 can start the printing process without delay.

When the user operates the paper feed button 9*c* while the access cover 11 of the case 9 is open in some embodiments of the invention, the roller pair 31 changes from the nip state to the release state. Because the user opens the access cover 11 that exposes the paper conveyance path 13 to the outside when removing printing paper P from the paper conveyance path 13, the operation of opening the access cover 11 is intuitive and easy to understand. Furthermore, because the user can set the second paper feed roller pair 31 to the release position by operating the paper feed button 9*c* after opening the access cover 11, operation is simple. In addition, because the paper feed button 9*c* is an operating button related to conveying the printing paper P, operating the paper feed button 9*c* in order to remove a paper jam that occurred while conveying the printing paper P will not feel unnatural for the user.

If the user closes the access cover 11 after removing the scrap of paper from the paper conveyance path 13, the second paper feed roller pair 31 returns from the release state to the nip state, and the printhead 12 returns from the printhead-up position 12U to the printhead-down position 12D in this embodiment. A separate operation for returning the second paper feed roller pair 31 to the nip state, and an operation returning the printhead 12 to the printhead-down position 12D, are therefore not necessary.

The printhead 12 also returns to the printhead-down position 12D when the access cover 11 is closed in this embodiment. Therefore, if the printhead 12 becomes uncapped by the head cap 57*a* and the printhead 12 becomes unprotected when the printhead 12 is at the home position 12HP and the printhead 12 is set to the printhead-up position 12U, for example, closing the access cover 11 can return the printhead 12 to the state in which it is protected by the head cap 57*a*. The printhead 12 can therefore be prevented from being left unprotected by the head cap 57*a*.

Because the second paper feed roller pair 31 is moved to the release position and the printhead 12 is moved to the printhead-up position 12U when the paper feed button 9*c* is operated for a set time or longer in this embodiment, changing the state of the second paper feed roller pair 31 and moving the printhead 12 as a result of accidental operation of the paper feed button 9*c* can be prevented.

OTHER EMBODIMENTS

In some embodiments of the invention the carriage lift mechanism 52 moves the carriage 45 up and down by moving the carriage guide rail 46 and the carriage support rail 47 up and down on the vertical axis Z, but the carriage lift mechanism 52 may also be configured to move the carriage 45 up and down on the carriage guide rail 46 and thermal head carriage support rail 47.

The roller pair state changing mechanism 37 moves the follower roller 31*b* in the embodiment described above, but a configuration in which the follower roller 31*b* is in a stationary position and the roller pair state changing mechanism 37 moves the second feed roller 31*a* is also conceivable. In this configuration, the second feed roller 31*a* can be moved between a position where pressure is applied by the follower roller 31*b* and a position separated from the follower roller 31*b*, and the second paper feed roller pair 31 can therefore be changed between a state nipping the printing paper P and a state in which the printing paper P is not nipped.

In the above example, the carriage lift mechanism 52 and the roller pair state changing mechanism 37 are driven by a common lift motor 53, and the carriage lift mechanism 52 and roller pair state changing mechanism 37 are driven together, but separate drive sources may be provided for the carriage lift mechanism 52 and the roller pair state changing mechanism 37, and these drive sources can be driven independently.

Although the present invention has been described in connection with the some embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a printhead;

a paper conveyance path extending past a print position of the printhead;

a conveyance roller pair that conveys recording paper through the paper conveyance path to the print position;

a case that houses the printhead, the paper conveyance path, and the conveyance roller pair;

a roller pair state changing mechanism that moves the conveyance roller pair alternately between a nip state and a nip-release state;

an access cover that is disposed to the case to open and close, and when open exposes a portion of the paper conveyance path including the print position;

an operating button;

a detector that detects if the access cover is open; and a nip state release control unit that, when the operating button is operated and the access cover is detected in the open position, drives the roller pair state changing mechanism and changes the conveyance roller pair to the nip-release state.

2. The printer described in claim 1, further comprising:

a nip state control unit that drives the roller pair state changing mechanism and returns the conveyance roller pair to the nip state when the open state of the access cover is not detected when the conveyance roller pair is in the nip-release state.

3. The printer described in claim 1, further comprising:

a platen that defines the print position;

a printhead moving mechanism that moves the printhead between a print position where the platen gap between the platen and the printhead is a first distance, and a retracted position where the platen gap is a second distance that is greater than the first distance;

a print control unit that sets the printhead to the print position and prints on recording paper at the print position;

a printhead retraction control unit that drives the printhead moving mechanism and moves the printhead from the print position to the retracted position if the operating button is operated while the access cover is detected in the open position; and a printhead return control unit that drives the printhead moving mechanism and returns the printhead to the print position if the printhead is at the retracted position when the access cover is not detected in the open position.

4. The printer described in claim 1, further comprising:

a paper feed control unit that drives the conveyance roller pair and conveys the recording paper a predetermined conveyance distance when the operating button is operated when the access cover is not detected in the open position.

5. The printer described in claim 3, wherein:

the nip-release control unit moves the conveyance roller pair from the nip state to the nip-release state when the operating button is operated for a predetermined time or more; and the printhead retraction control unit moves the printhead from the print position to the retracted position when the operating button is operated for the set time or longer.

6. A control method of a printer, comprising:

detecting an open state of an access cover that exposes a paper conveyance portion including the print position of a printhead on a paper conveyance path to the outside of a case that houses a conveyance roller pair, the printhead, and the paper conveyance path;

changing the conveyance roller pair from a nip state to a nip-release state if an operating button is operated and if the access cover is detected as being open; and returning the conveyance roller pair to the nip state when the access cover closes.

7. The control method of a printer described in claim 6, further comprising:

setting the printhead to a print position where the platen gap to the platen defining the print position is a first distance enabling printing, and printing;

moving the printhead to a retracted position where the platen gap is a second distance that is greater than the first distance when the operating button is operated while the access cover is open; and returning the printhead from the retracted position to the print position when the access cover is closed.

8. The control method of a printer described in claim 6, further comprising:

conveying the recording paper a predetermined conveyance distance by the conveyance roller pair when the operating button is operated while the access cover is closed.

9. The control method of a printer described in claim 7, further comprising:

moving the conveyance roller pair from the nip state to the nip-release state, and moving the printhead from the print position to the retracted position, if the operating button is operated for the predetermined time or more.

* * * * *